US008175497B2

(12) United States Patent
Kobashi et al.

(10) Patent No.: US 8,175,497 B2
(45) Date of Patent: May 8, 2012

(54) IMAGE FORMING APPARATUS APPLYING PROTECTIVE AGENT

(75) Inventors: Masaru Kobashi, Matsumoto (JP); Yoichi Yamada, Shiojiri (JP); Masahiro Maeda, Matsumoto (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 408 days.

(21) Appl. No.: 12/502,881

(22) Filed: Jul. 14, 2009

(65) Prior Publication Data

US 2010/0014890 A1 Jan. 21, 2010

(30) Foreign Application Priority Data

Jul. 17, 2008 (JP) ..... 2008-185454

(51) Int. Cl.
*G03G 15/00* (2006.01)
*G03G 15/02* (2006.01)
*G03G 21/00* (2006.01)

(52) U.S. Cl. ..... 399/168; 399/50; 399/71; 399/346

(58) Field of Classification Search ..... 399/168
See application file for complete search history.

(56) References Cited

U.S. PATENT DOCUMENTS 5,600,430 A * 2/1997 Folkins et al. ..... 399/171
6,167,224 A * 12/2000 Dalal ..... 399/222
6,295,437 B1 * 9/2001 Hodoshima et al. ..... 399/346
7,209,699 B2 * 4/2007 Yamaguchi et al. ..... 399/346
8,032,059 B2 * 10/2011 Klenkler et al. ..... 399/171
2007/0166087 A1 * 7/2007 Yamaguchi et al. ..... 399/346
2007/0258743 A1 * 11/2007 Shakuto et al. ..... 399/346
2009/0052939 A1 * 2/2009 Yoshino et al. ..... 399/111
2010/0046974 A1 * 2/2010 Gross et al. ..... 399/71
2010/0046975 A1 * 2/2010 Gross et al. ..... 399/71

FOREIGN PATENT DOCUMENTS

JP 09-081005 3/1997
JP 3455672 10/2003
JP 2007-086262 4/2007
JP 2007-240699 9/2007
JP 2008-122869 5/2008

* cited by examiner

*Primary Examiner* — David M. Gray
*Assistant Examiner* — David Bolduc
(74) *Attorney, Agent, or Firm* — DLA Piper LLP (US)

(57) ABSTRACT

Provided is an image forming apparatus including: a rotatable image carrier; a protective agent supplying unit supplying a protective agent to the image carrier; a first charging unit charging the image carrier to the same polarity as a regular charging polarity of a toner; a second charging unit charging the protective agent supplied to the image carrier to the opposite polarity to the regular charging polarity of the toner; an exposure unit forming an electrostatic latent image on the image carrier; a development unit developing the electrostatic latent image of the image carrier; and a transfer unit transferring the image of the image carrier, wherein the second charging unit is disposed between the protective agent supplying unit and the development unit.

10 Claims, 3 Drawing Sheets

IMAGE FORMING APPARATUS APPLYING PROTECTIVE AGENT

BACKGROUND

Technical Field

The present invention relates to an image forming apparatus such as a copier, a facsimile machine or a printer, and, more particularly, an image forming apparatus which includes an image carrier, a charging unit for charging the image carrier, an exposure unit for forming an electrostatic latent image on the image carrier charged by the charging unit by exposure, and a development unit for developing the electrostatic latent image formed by the exposure unit, and a transfer unit for transferring the image developed by the development unit so as to apply a protective agent on an image carrier, and controls the charging polarity of a protective agent applied on the image carrier so as to suppress mixing of the protective agent into development unit and to prevent filming or image nonuniformity.

Since the deterioration of resin configuring a photosensitive layer or generation of a discharge product being adhered to the surface of a photosensitive body can be suppressed by applying the protective agent on a photosensitive body such as stearic acid, the prolongation of the life of the photosensitive body can be realized. In addition, since abrasion of the front contact portion of a blade or driving torque of the photosensitive body can be reduced in a process having a cleaner blade, particularly, a configuration for applying the protective agent by a high-speed machine or a large-sized machine is generally used.

Most of the higher fatty acids (stearic acid or the like) which is widely used as the protective agent has a low melting point, and if higher fatty acid is mixed to a development device, filming is caused. In particular, in the high-speed machine, since the rotation speed of a development roller is high, a heating temperature of the development roller is also increased by heating of a gear portion or friction heat of a seal portion and thus filming is apt to be more easily generated.

In one-component development system, if a large amount of protective agent is mixed into the development device, friction in the contact portion with a supply member or a contact portion with a regulation member is changed, and the supply property of the toner or the transportation property and the charging property of the toner is influenced even though filming is not caused, and image quality deterioration, fog, scattering, or omission may be caused. In addition, in a contact development using a rubber roller, since a development roller or the toner transported onto the development roller is directly brought in contact with the protective agent applied on the photosensitive body, the protective agent applied on the photosensitive body is apt to be more easily mixed into the development unit and thus the above-described problem further becomes serious.

Due to this reason, it is difficult to realize the prolongation of the life of the photosensitive body by the configuration for applying the protective agent on the photosensitive body in the one-component development system. Meanwhile, even in two-component development, since a magnetic napping is brought into contact with the photosensitive body, the mixing of the protective agent on the photosensitive body into the development device is not completely suppressed and a sufficient amount of protective agent cannot be applied on the photosensitive body in consideration of the filming of the carrier or the like. In mixing of the protective agent into the development device, in addition to the movement due to physical attachment due to contact between the photosensitive body and the development roller, if a protective material is charged, there is movement due to an electric field force between the photosensitive body and the development roller and the mixing of the protective agent into the development unit cannot be prevented only by non-contact between the development roller and the photosensitive body. In addition, with respect to the protective agent left on the photosensitive body, if the protective agent is charged to the same polarity as the regular polarity of the toner, since the attachment of the toner onto the exposure unit on the photosensitive body is disturbed, toner concentration in a printing unit is decreased or concentration nonuniformity occurs. In addition, if the protective agent is attached to a transfer roller or the like, a transfer property deteriorates or a transportation property of a transfer material deteriorates so as to cause a paper jam. In a color machine, a surface layer of a transfer belt or a surface layer of a transfer drum functioning as an intermediate transfer body may be contaminated or transfer nonuniformity may occur.

As known technologies of applying the protective agent on the photosensitive body, JP-A-2007-86262 discloses an image forming apparatus for applying a protective agent by an applying member after charging, uniformizing the protective agent by a uniformizing member, and then performing a development process. In addition, JP-A-9-81005 and JP-A-2007-240699 disclose an image forming apparatus for charging a photosensitive body after a protective agent is applied. Japanese Patent No. 3455672 discloses an image forming apparatus for removing a surplus protective agent by a development device.

However, in JP-A-2007-86262, a unit for preventing transferring of the protective agent to a development device or a transfer member is not considered and development filming or the contamination of the transfer member cannot be prevented. In addition, since the contact member is present after the image carrier is charged, charging uniformity of the image carrier is lost by friction of the contact member or the like, crack or nonuniformity occurs, and high image quality cannot be realized. In addition, according to a charged column of the contact member, the protective agent may be charged by friction with the contact member to cause mixing into the development unit.

In JP-A-9-81005 and JP-A-2007-240699, since the photosensitive body is charged after the protective agent is applied, the uniformity of the charging potential of the photosensitive body is ensured, but the protective agent is charged to the same polarity as the regular polarity of the toner by the charging unit, the protective agent deteriorated in the charging unit is transported to the development unit of the downstream side, the protective agent is mixed into the development device in the development unit, and filming of the development roller deteriorates.

In Japanese Patent No. 3455672, the surplus protective agent is removed by the development device. However, a sufficient amount of protective agent for protecting a photosensitive layer cannot be supplied in consideration of filming of the carrier in the two-component development system or filming of the development roller in one-component development system, and prolongation of the life of the development device cannot be realized.

SUMMARY

An advantage of some aspects of the invention is that it provides an image forming apparatus for applying a protective agent to a photosensitive body, which are capable of preventing mixing of the protective agent into a development unit and transferring of the protective agent to a transfer member of a transfer unit.

According to an aspect of the invention, there is provided an image forming apparatus including: a rotatable image carrier; a protective agent supplying unit supplying a protective agent to the image carrier; a first charging unit charging the image carrier to the same polarity as a regular charging polarity of a toner; a second charging unit charging the protective agent supplied to the image carrier to the opposite polarity to the regular charging polarity of the toner; an exposure unit forming an electrostatic latent image on the image carrier; a development unit developing the electrostatic latent image of the image carrier; and a transfer unit transferring the image of the image carrier. The second charging unit is disposed between the protective agent supplying unit and the development unit. Accordingly, the protective agent applied on the image carrier is charged to the opposite polarity to the polarity of the toner and is not recovered to the development device by a potential difference between the non-exposure unit of the photosensitive body and the development roller in the non-exposure unit. Meanwhile, since the protective agent is recovered by a potential difference between the exposure unit of the photosensitive body and the development roller in the exposure unit but the toner is developed in the exposure unit, a probability in which the protective agent is recovered to the development device is low, the area of a printing unit upon actual printing is generally smaller than that of a non-printing unit. If the printing area is large, the consumption of toner is large, a risk in which the toner or the protective agent continues to stay on the development roller is decreased and a risk of filming is reduced. Accordingly, in the invention, the configuration in which the protective agent applied on the photosensitive body is not recovered in the non-exposure unit is of importance. By charging the protective agent to the opposite polarity to the polarity of the toner, the protective agent is not transferred by the transfer unit and the protective agent is not transferred to the transfer member or the transfer belt. Since the protective agent is charged to the opposite polarity to the regular charging polarity of the toner before development, the toner having the regular charging polarity is not electrostatically repulsed in the exposure unit of the photosensitive body and thus the concentration of the printing unit is not reduced. In addition, in the non-exposure unit of the photosensitive body, the protective agent charged to the opposite polarity to the regular charging polarity of the toner repulses the fogged toner having the opposite polarity to the regular charging polarity of the toner, fogging can be suppressed. If the protective agent is not charged, the transferring of the protective agent due to the contact of the development unit in the contact development or the transfer unit cannot be prevented. However, in the invention, by applying the opposite polarity to the charging polarity of the toner to the protective agent, the transferring of the protective agent by the photosensitive body and the transfer member or the development roller can be suppressed by force of an electric field.

In the image forming apparatus of the invention, the second charging unit may charge the image carrier to a potential smaller than the potential of the image carrier charged by the first charging unit in an absolute value thereof. Accordingly, the second charging unit can charge the protective agent to the opposite polarity to the regular charging polarity of the toner while maintaining the same charging polarity of the regular charging polarity of the toner charged by the first charging unit.

In the image forming apparatus of the invention, the second charging unit may be disposed next to the first charging unit. Accordingly, the first charging unit charges the image carrier to the same polarity of the regular charging polarity of the toner and both the first charging unit and the second charging unit adjust the image carrier to a desired charting potential. Since the charging potential of the image carrier is adjusted by the second charging unit at the downstream side of the protective agent supplying unit, the charging potential of the image carrier which becomes nonuniform by the contact of the protective agent supplying unit or the protective agent attached to the surface may be uniformized again.

In the image forming apparatus of the invention, the protective agent supplying unit may be disposed at the upstream side of the first charging unit. Accordingly, a sufficient amount of protective agent can be supplied to the charging portion of the first charging unit which most deteriorates the surface of the image carrier.

The image forming apparatus of the invention may further include an image carrier cleaner cleaning the image carrier after transfer, and the protective agent supplying unit may be disposed between the first charging unit disposed next to the image carrier cleaner and the second charging unit. Accordingly, since the protective agent becomes uniform by the image carrier cleaner and is charged into the first charging unit in a state of being filmed, the surface of the image carrier can be uniformly protected.

In the image forming apparatus of the invention, the second charging unit may be a charging roller which is in contact with the image carrier. Accordingly, a DC bias exceeding a discharge limit of a plus side is applied between the charging roller and the image carrier. Even in the contact DC charging, since the protective agent is present, minute discharge can be suppressed before and after a nip and minute charging nonuniformity can be prevented.

In the image forming apparatus of the invention, the second charging unit may be a corona charger which is not in contact with the image carrier. Accordingly, the protective agent is not adhered to the charger, deterioration of charging performance of the second charging unit can be prevented, and prolongation of the life can be realized. In the image forming apparatus of the invention, the corona charger may be a scorotron charger, apply a bias having the same polarity as the regular charging polarity of the toner to a grid, and flow current having the opposite polarity to the regular charging polarity of the toner to a wire. Accordingly, corona having the opposite polarity to the regular charging polarity of the toner can be spread while maintaining the charging potential of the image carrier at the same polarity as the regular charging polarity of the toner, and the protective agent can be charged to the opposite polarity to the regular charging polarity of the toner. In addition, since the charging potential of the image carrier attains an equilibrium state at a grid voltage, it is possible to uniformize the charging potential of the image carrier which becomes nonuniform due to the applying of the protective agent or the rubbing of the protective agent supplying unit. The second charging unit can perform neutralizing by a potential for eliminating the nonuniformity of the charging generated due to the first charging unit and minimize the generation of ozone or the generation of the discharge product in the auxiliary charging unit, and the deterioration of the photosensitive layer.

In the image forming apparatus of the invention, the development unit may not be in contact with the image carrier. It is possible to prevent physical mixing of the protective agent due to the contact of the development member. In addition, even when the charging of the protective agent is weak, it is easy to prevent or suppress the mixing of the protective agent into the development device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
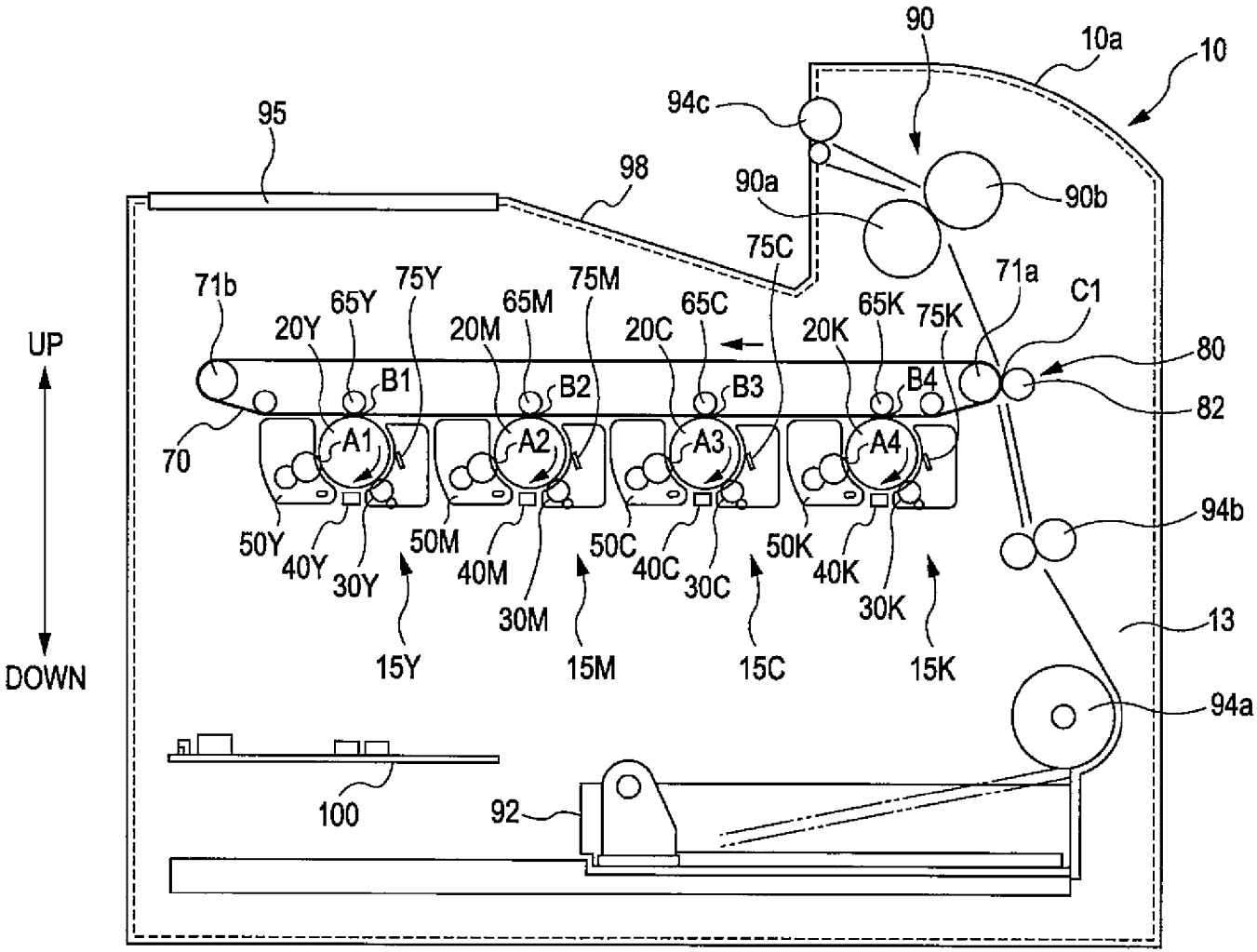
FIG. 1 is a view showing the whole of an image forming apparatus according to the invention.

Hereinafter, embodiments of the invention will be described with reference to the accompanying drawings. FIG. 1 is a view showing the whole of an image forming apparatus according to the invention.

As shown in FIG. 1, the image forming apparatus 10 includes four image forming stations 15 (Y, M, C and K), an intermediate transfer belt 70, a secondary transfer unit 80, a fixing unit 90, a display unit 95 including a reporting unit to a user and including a liquid crystal panel, and a control unit 100 for controlling these units and performing the operation of the image forming apparatus.

The image forming stations 15 (Y, M, C and K) have the function to form an image by the yellow (Y), magenta (M), cyan (C) and black (K) toners. The configurations of the image forming stations 15 (Y, M, C and K) are equal and, hereinafter, the image forming station 15Y will be described.

As shown in FIG. 1, the image forming station 15Y has a charging unit 30Y, an exposure unit 40Y, a development unit 50Y, a primary transfer portion B1 and a photosensitive body cleaning unit 75Y in a rotation direction of a photosensitive body 20Y which is an example of an image carrier.

The photosensitive body 20Y has a cylindrical base material and a photosensitive layer formed on the circumferential surface thereof, can rotate around a central axis, and, in the present embodiment, rotates in a clockwise direction as denoted by an arrow.

The charging unit 30Y is a device for charging the photosensitive body 20Y. An electrostatic latent image is formed on the charged photosensitive body 20Y by irradiating laser from the exposure unit 40Y.

The exposure unit 40Y has a semiconductor laser, a polygon mirror, an F-θ lens and the like, and irradiates modulated laser onto the charged photosensitive body 20Y based on an image signal input from a host computer (not shown) such as a personal computer or a word processor.

The development unit 50Y is a device for developing the latent image formed on the photosensitive body 20Y using the toner of yellow (Y). In the development unit 50Y, a development roller and a toner supply roller are arranged in a development chamber to which a new toner is supplied from a replaceable toner cartridge, and a regulation blade is brought into contact with the development roller such that the toner on the development roller thins.

The primary transfer portion B1 transfers a yellow toner image formed on the photosensitive body 20Y onto the intermediate transfer belt 70. In the primary transfer unit B1, a primary transfer roller 65Y for applying a primary transfer bias is disposed. When four toners are sequentially transferred to be superposed by the primary transfer units B1, B2, B3 and B4, a full-color toner image is formed on the intermediate transfer belt 70.

The intermediate transfer belt 70 is an endless belt stretched over a belt driving roller 71*a* and a driven roller 71*b* and is rotated and driven in a state of being in contact with the photosensitive bodies 20 (Y, M, C and K).

The secondary transfer unit 80 is a device for applying a secondary transfer bias from a secondary transfer roller 82 in a secondary transfer portion C1 and transferring a single-color toner image and a full-color toner image formed on the intermediate transfer belt 70 to a transfer material such as paper, a film, cloths or the like.

The fixing unit 90 is a device which includes a fixing roller 90*a* and a pressurization roller 90*b* and fuses the single-color toner image or the full-color toner image transferred on the transfer material to a permanent image.

The photosensitive body cleaning unit 75Y is a device which includes a photosensitive body cleaning blade 76Y made of rubber and being in contact with the surface of the photosensitive body 20Y and scraps and removes the toner left on the photosensitive body 20Y by the photosensitive body cleaning blade 76Y after the toner image is transferred onto the primary transfer portion B1 and the intermediate transfer belt 70.

Next, the operation of the image forming apparatus 10 having the above-described configuration will be described.

First, an image signal and a control signal from a host computer (not shown) is input to a main controller of the image forming apparatus via an interface, the photosensitive body 20Y, the development roller provided in the development unit 50Y, the intermediate transfer belt 70 and the like are rotated under the control of a unit controller based on the command from the main controller. The photosensitive body 20Y is sequentially charged by the charging unit 30Y at a charging position while rotating.

The charged region of the photosensitive body 20Y reaches an exposure position by the rotation of the photosensitive body 20Y such that the latent image according to the image information of yellow (Y) is formed in the region by the exposure unit 40Y.

The latent image formed on the photosensitive body 20Y reaches to a development position by the rotation of the photosensitive body 20Y so as to be developed by the development unit 50Y. Accordingly, the toner image is formed on the photosensitive body 20Y.

The toner image formed on the photosensitive body 20Y reaches the position of the primary transfer portion El by the rotation of the photosensitive body 20Y so as to be transferred onto the intermediate transfer belt 70 by the primary transfer unit. At this time, a primary transfer voltage having an opposite polarity to a charging polarity of the toner is applied from the primary transfer roller 65Y in the primary transfer unit. As a result, the four toner images formed on the photosensitive bodies 20 (Y, M, C and K) are transferred so as to be superposed on the intermediate transfer belt 70, and the full-color toner image is formed on the intermediate transfer belt 70.

The intermediate transfer belt 70 is driven by sending driving force from a belt driving unit such as a motor via the belt driving roller 71*a*.

The full-color toner image formed on the intermediate transfer belt 70 is transferred onto the transfer material such as paper by the secondary transfer unit 80 by applying the secondary transfer bias from the secondary transfer roller 82 in the secondary transfer portion C1. Such a transfer material is transported from a feed tray to the secondary transfer unit 80 using a feed roller 94*a* and a registration roller 94*b*.

The full-color toner image transferred onto the transfer material is heated and pressurized by the fixing unit 90 so as to be fused on the transfer material. The transfer material is ejected by an ejection roller 94*c* after passing through the fixing unit 90.

Meanwhile, the photosensitive bodies 20 (Y, M, C and K) are neutralized by a neutralizing unit (not shown) after passing the positions of the primary transfer portions B1, B2, B3 and B4, and the toners attached to the surfaces thereof are scraped by the photosensitive body cleaning blades supported on the photosensitive body cleaning units 75 (Y, M, C and K) so as to prepare for a next charging process for forming the latent image. The scraped toners are recovered into residual toner recovery portions included in the photosensitive body cleaning units 75 (Y, M, C and K).

An intermediate transfer belt cleaning device (not shown) is provided on the side of the driven roller 71*b* of the intermediate transfer belt 70 after secondary transfer, and the intermediate transfer belt 70 after secondary transfer is cleaned.

In addition, although the embodiment of the intermediate transfer method using the intermediate transfer belt is described, a direct transfer type image forming apparatus may be used.

In such an image forming apparatus 10, by applying a protective agent such as stearic acid on the photosensitive bodies 20 (Y, M, C and K), deterioration of resin configuring the photosensitive layer or generation of discharge products attached to the surfaces of the photosensitive bodies 20 (Y, M, C and K) can be suppressed. Thus, prolongation of the life of the photosensitive bodies 20 (Y, M, C and K) can be realized. In the process having the photosensitive body cleaning blades 76 (Y, M, C and K), abrasion of a front contact portions of the photosensitive body cleaning blades 76 (Y, M, C and K) or driving torque of the photosensitive bodies 20 (Y, M, C and K) can be reduced.

Figure 2:
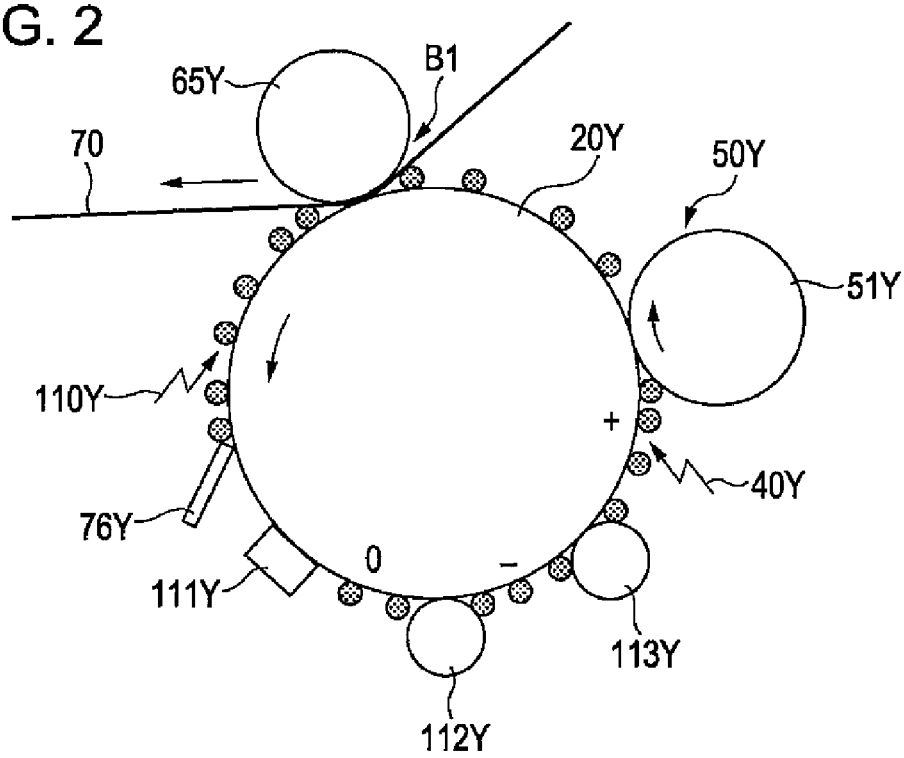
FIG. 2 is a view showing the embodiment of the invention.

FIG. 2 shows an image forming apparatus according to Embodiment 1 for solving the problems of the known apparatus in the image forming apparatus 10 for applying the protective agent on the photosensitive bodies 20 (Y, M, C and K). Although the image forming apparatus of Embodiment 1 may be applied to a single-color image forming apparatus, FIG. 2 shows, for example, the yellow image forming unit 15Y of a color image forming apparatus.

The photosensitive body 20Y has the cylindrical conductive base material and the photosensitive layer formed on the circumferential surface thereof, can rotate around the central axis, and, in Embodiment 1 shown in FIG. 2, rotates in a counter-clockwise direction as denoted by an arrow.

In the photosensitive body 20Y, a neutralizing unit 110Y made of a Light Emitting Diode (LED) or the like is disposed at the downstream side of the primary transfer portion B1 such that the photosensitive body 20Y is neutralized. The photosensitive body cleaning blade 76Y supported by the photosensitive body cleaning unit 75Y is disposed at the downstream side of the neutralizing unit 110Y in counter contact with the rotation direction of the photosensitive body 20Y so as to clean the photosensitive body 20Y after primary transfer.

A protective agent supplying unit 111Y is disposed at the downstream side of the photosensitive body cleaning blade 76Y. Since the protective agent can protect the photosensitive layer of the photosensitive body 20Y and have lubricant effect, abrasion or local chipping is prevented if the photosensitive body cleaning blade 76Y is used as the photosensitive body cleaning unit 75Y. Metal salt of fatty acid may be used as the protective agent, and the protective agent may be formed in a powder shape or a solid shape according to the method of supplying the protective agent to the photosensitive body 20Y. In order to solve the problem such as scattering, the protective agent having the solid shape is preferably used. The metal elements configuring metal salt of fatty acid may include, for example, zinc, lithium, sodium, magnesium, aluminum, lead, nickel and the like, and fatty acid configuring metal salt of fatty acid may include, for example, stearic acid, lauric acid, palmitic acid and the like. Among them, if the protective agent having the solid shape is used, zinc stearate is preferably used. In Embodiment 1, as the protective agent supplying unit 111Y, a zinc stearate block is brought into contact with the photosensitive body 20Y so as to supply the protective agent to the photosensitive body 20Y.

A first charging unit 112Y which is a main charging unit is disposed at the downstream side of the protective agent supplying unit 111Y. The first charging unit 112Y charges the photosensitive body 20Y to the same polarity as the regular charging polarity of the toner. The first charging unit 112Y of Embodiment 1 is a contact charging roller made of a conductive rubber roller and a DC bias exceeding a discharge limit is applied between the first charging unit and the photosensitive body. A charging roller which is the first charging unit 112Y is driven by the rotation of the photosensitive body 20Y and is rotated in the direction (clockwise direction) opposite to the rotation direction (counter-clockwise direction) of the photosensitive body 20Y. In Embodiment 1, a DC bias of −1300 V exceeding 600 V which is the discharge limit used in the present embodiment is applied to the first charging unit 112Y such that the potential of the photosensitive body 20Y is charged to −700 V.

A second charging unit 113Y which is an auxiliary charging unit is disposed at the downstream side of the first charging unit 112Y. The second charging unit 113Y charges the protective agent supplied to the photosensitive body 20Y by the protective agent supplying unit 111Y to the opposite polarity to the regular charging polarity of the toner. The second charging unit 113Y of Embodiment 1 is a contact charging roller made of a conductive rubber roller, and a DC bias exceeding the discharge limit at a plus side is applied between the second charging unit and the photosensitive body 20Y. A charging roller which is the second charging unit 113Y is driven by the rotation of the photosensitive body 20Y and is rotated in the direction (clockwise direction) opposite to the rotation direction (counter-clockwise direction) of the photosensitive body 20Y. In Embodiment 1, a DC bias of +100 V is applied to the second charging unit 113Y. Accordingly, a potential difference with the surface of the photosensitive body charged by the second charging unit and the first charging unit becomes 800 V exceeding 600 V, corona discharge occurs between the second charging unit and the photosensitive body, and the potential of the photosensitive body 20Y becomes −500 V. That is, the second charging unit 113Y charges the photosensitive body such that the charging potential of photosensitive body 20Y is smaller than the potential of the photosensitive body charged by the first charging unit 112Y in an absolute value thereof. In the charging process of the second charging unit, a minute gap before and after the contact portion between the charging roller and the photosensitive body, plus corona is showered from the charging roller, which is the second charging unit, to the surface of the photosensitive body and the protective agent applied on the photosensitive body is charged to the plus polarity which is the opposite polarity to the regular polarity of the toner.

The exposure unit 40Y is disposed at the downstream side of the second charging unit 113Y. The exposure unit 40Y has a semiconductor laser, a polygon mirror, an F-θ lens and the like, and irradiates modulated laser onto the charged photosensitive body 20Y based on an image signal input from a host computer (not shown) such as a personal computer or a word processor.

The development unit 50Y is disposed at the downstream side of the exposure unit 40Y. The photosensitive body 20Y in which the latent image according to the image information of yellow Y is formed in the region by the exposure unit 40Y is developed by the development unit 50Y. In the development unit 50Y of Embodiment 1, a development roller 51Y is disposed at a predetermined development gap with the photosensitive body 20Y in a non-contact manner. The thin toner layer charged by a toner supplying roller or a regulation blade is formed on the development roller 51Y. A development bias obtained by superposing an AC on a DC is applied to the development roller 51Y, the toner flies onto the surface of the photosensitive body 20Y, and the latent image of the photosensitive body 20Y is developed.

The primary transfer unit is disposed at the downstream side of the development unit 50Y. The primary transfer unit applies a primary transfer voltage having the opposite polarity to the regular charging polarity of the toner to the primary transfer roller 65Y which is in contact with the photosensitive body 20Y via the intermediate transfer belt 70 in the primary transfer portion B1, and transfers the image of the photosensitive body 20Y to the intermediate transfer belt 70.

The operation of the image forming process of Embodiment 1 is shown in Table 1.

TABLE 1

| Process | Member | Applied bias | Potential of photosensitive body | Polarity of protective agent |
|---|---|---|---|---|
| Protective agent | Zinc stearate (block) | | 0 V | None or small amount 0 |
| First charging unit | Conductive rubber roller (rotated by rotation of photosensitive body) | Vr1: −1300 V | −700 V | − |
| Second charging unit | Conductive rubber roller (rotated by rotation of photosensitive body) | Vr2: +100 V | −500 V | + |
| Exposure | Laser | | −100 V/−500 V | |
| Development | AC non-contact | Vavg: −150 V Vpp: 1300 V | | |
| Primary transfer | Intermediate transfer belt PET base material | Vt = +400 V | | |
| Neutralizing | LED | | 0 V | |
| Cleaning | Blade counter contact | | | |

The result of the process of the image forming apparatus of Embodiment 1 shown in Table 1 is shown in Table 2.

TABLE 2

| | Embodiment 1 |
|---|---|
| Mixing of protective agent into development device | Δ |
| Discharge product | Δ |
| Removal of photosensitive film | Δ |
| Generation of ozone | ○ |
| Abrasion of blade | ○ |

TABLE 2-continued

| | Embodiment 1 |
|---|---|
| Contamination of charging member | Δ |
| Charging uniformity | Δ |

In the image forming apparatus of Embodiment 1, by disposing the second charging unit 113Y at the downstream side of the protective agent supplying unit 111Y and at the upstream side of the development unit 50Y, the protective agent is charged to the opposite polarity to the polarity of the toner, and is not recovered to the development unit by a potential difference between the development roller and the non-exposure unit of the photosensitive body in the non-exposure unit. Since the protective agent is recovered by a potential difference between the exposure unit of the photosensitive body and the development roller in the exposure unit but the toner is developed in the exposure unit, a probability in which the protective agent is recovered to the development device is low, the area of a printing unit upon actual printing is generally smaller than that of a non-printing unit. If the printing area is large, consumption of toner is large, the risk in which the toner or the protective agent continues to stay on the development roller 51Y is decreased and the risk of filming is reduced. Accordingly, in the image forming apparatus of Embodiment 1, the configuration in which the protective agent is not recovered in the non-exposure unit is of importance. In the present configuration, although the contact DC charger using the contact charging roller is used as the second charging unit 113Y, in order to attach the protective agent to the surface of the charging roller to improve smoothness of the surface of the charging roller, minute abnormal discharge generated before and after the nip of the photosensitive body and the charging roller can be suppressed and minute discharge nonuniformity can be prevented.

In addition, the protective agent is not transferred even in the primary transfer portion B1, and the protective agent is not transferred to the intermediate transfer belt 70. Accordingly, in the present embodiment, the protective agent reaches the first charging unit 112Y which is the main charging unit, and can protect the photosensitive body when charging is performed in the first charging unit. In addition, since the protective agent is charged to the plus potential before the development unit, the toner to be developed is prevented from being electrostatically repulsed in the exposure unit of the photosensitive body and the concentration is not reduced in the printing unit. Meanwhile, in the non-exposure unit of the photosensitive body, the protective agent charged to the plus potential repulses the fogged toner charged to the plus potential, fogging can be suppressed. If the protective agent is not charged, the transferring of the protective agent due to the contact of the development unit in the contact phenomenon or the transfer unit cannot be prevented. However, in the invention, by applying the opposite polarity to the charging polarity of the toner to the protective agent, the transferring of the protective agent by the photosensitive body and the transfer member or the development roller can be suppressed by force of an electric field In the image forming apparatus of Embodiment 1, the first charging unit 112Y is provided at the upstream side of the second charging unit 113Y, the first charging unit 112Y charges the photosensitive body 20Y to the same polarity of the regular charging polarity of the toner, and both the first charging unit 112Y and the second charging unit 113Y adjust the photosensitive body 20Y to a desired charging potential. Since the charging potential of the photosensitive body is adjusted by the second charging unit 113Y at the downstream side of the protective agent supplying unit 111Y, the charging potential of the photosensitive body 20Y which becomes nonuniform by the contact of the protective agent supplying unit 111Y or the protective agent attached to the surface may be uniformized again.

In the image forming apparatus of Embodiment 1, since the development is performed in a non-contact manner, it is possible to prevent mixing of the physical protective agent due to the contact of the development member. Even when the charging of the protective agent is weak, it is easy to prevent mixing of the protective agent into the development device.

Figure 3:
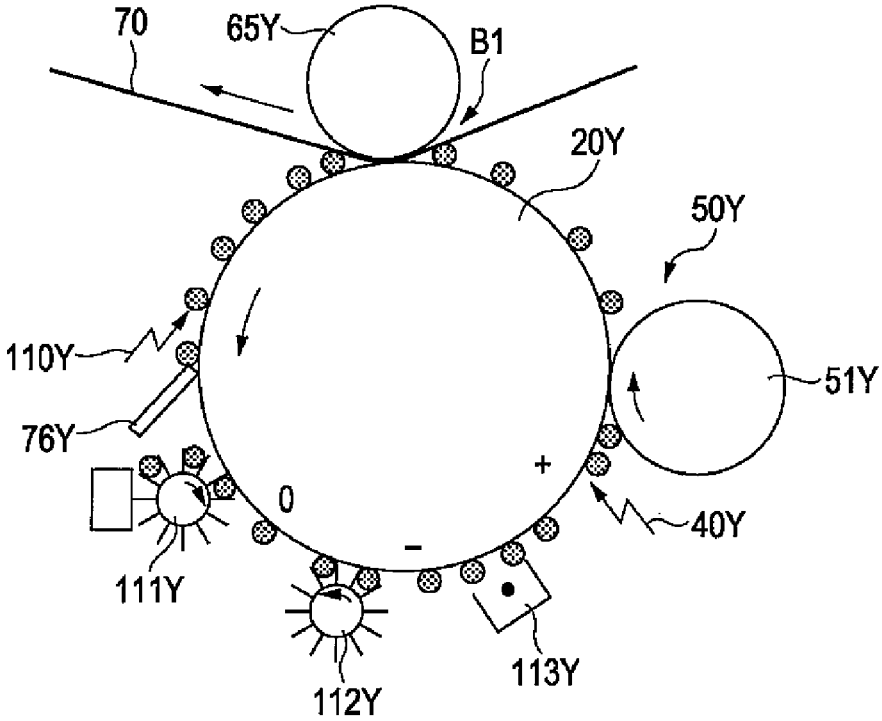
FIG. 3 is a view showing the embodiment of the invention.

FIG. 3 shows an image forming apparatus according to Embodiment 2 for solving the problems of the known apparatus, in the image forming apparatus 10 for applying the protective agent on the photosensitive bodies 20 (Y, M, C and K). Although the image forming apparatus of Embodiment 2 may be applied to a single-color image forming apparatus, FIG. 3 shows, for example, a yellow image forming unit 15Y of a color image forming apparatus.

In the photosensitive body 20Y, a neutralizing unit 110Y made of a Light Emitting Diode (LDE) or the like is disposed at the downstream side of the primary transfer portion B1 such that the photosensitive body 20Y is neutralized. The photosensitive body cleaning blade 76Y supported by the photosensitive body cleaning unit 75Y is disposed on the downstream side of the neutralizing unit 110Y in counter contact with the rotation direction of the photosensitive body 20Y so as to clean the photosensitive body 20Y after primary transfer. The contact pressure of the photosensitive body cleaning blade 76Y to the photosensitive body 20Y is 25 g/cm.

The protective agent supplying unit 111Y is disposed at the downstream side of the photosensitive body cleaning blade 76Y. In Embodiment 2, as the protective agent supplying unit 111Y, an insulating brush roller on which the protective agent is applied from a zinc stearate block supplies the protective agent to the photosensitive body 20Y. The insulating brush roller is rotated in the clockwise direction which is the opposite direction to the rotation direction of the photosensitive body 20Y.

A first charging unit 112Y which is a main charging unit is disposed at the downstream side of the protective agent supplying unit 111Y. The first charging unit 112Y charges the photosensitive body 20Y to the same polarity as the regular charging polarity of the toner. The first charging unit 112Y of Embodiment 2 is a conductive brush roller. The conductive brush roller which is the first charging unit 112Y is rotated in the same direction (counter-clockwise direction) as the rotation direction (counter-clockwise direction) of the photosensitive body 20Y. In Embodiment 2, a DC bias of −1500 V exceeding 600 V which is the discharge limit of the photosensitive body used in the present embodiment is applied to the first charging unit 112Y such that the potential of the photosensitive body 20Y is charged to −900 V.

A second charging unit 113Y which is an auxiliary charging unit is disposed at the downstream side of the first charging unit 112Y. The second charging unit 113Y charges the protective agent supplied to the photosensitive body 20Y by the protective agent supplying unit 111Y to the opposite polarity to the regular charging polarity of the toner. The second charging unit 113Y of Embodiment 2 uses a non-contact type scorotron charger. The scorotron charger applies a bias of −500 V having the same polarity as the regular charging polarity of the toner to a grid, flows current of +200 μA having the opposite polarity to the regular charging polarity of the toner to a wire, spreads corona having the opposite polarity to the regular charging polarity of the toner on the image carrier while maintaining the charging potential of the photosensitive body at the same polarity as the regular charging polarity of the toner, and charges the protective agent to the opposite polarity to the regular charging polarity of the toner. The potential of the photosensitive body 20Y after charging by the second charging unit 113Y becomes −500 V.

The configuration in which the exposure unit 40Y is disposed at the downstream side of the second charging unit 113Y, the development unit 50Y is disposed at the downstream side of the exposure unit 40Y and the primary transfer unit is disposed at the downstream side of the development unit 50Y is equal to that of the image forming apparatus of Embodiment 1 and thus the description thereof will be omitted.

The operation of the image forming process of Embodiment 2 is shown in Table 3.

TABLE 3

| Process | Member | Applied bias | Potential of photosensitive body | Polarity of protective agent |
|---|---|---|---|---|
| Protective agent | Brush roller (insulating) | | 0 V | None or small amount 0 |
| First charging unit | Brush roller (insulating) | Vbr: −1500 V | −900 V | − |
| Second charging unit | Scorotron | Vg: −500 V<br>Iw: +200 μA | −500 V | + |
| Exposure | Laser | | −100 V/−500 V | |
| Development | AC non-contact (metallic roller) | Vavg: −150 V<br>Vpp: 1300 V | | |
| Primary transfer | Intermediate transfer belt (PET base material) | Vt = +400 V | | |
| Neutralizing | LED | | 0 V | |
| Cleaning | Blade counter contact | | | |

The result of the process of the image forming apparatus of Embodiment 2 shown in Table 3 is shown in Table 4.

TABLE 4

| | Embodiment 2 |
|---|---|
| Mixing of protective agent into development device | ○ |
| Discharge product | ○ |
| Removal of photosensitive film | ○ |
| Generation of ozone | Δ |
| Abrasion of blade | ○ |
| Contamination of charging member | Δ |
| Charging uniformity | ○ |

In the image forming apparatus of Embodiment 2, similar to Embodiment 1, since the protective agent supplying unit 111Y, the first charging unit 112Y, the second charging unit 113Y, the exposure unit 40Y, the development unit 50Y, and the primary transfer unit are disposed in this order, the same operation and effect as the image forming apparatus of Embodiment 1 can be obtained.

The image forming apparatus of Embodiment 2, since the non-contact type scorotron corona charger is used as the second charging unit 113Y, the protective agent is not adhered to the charger, deterioration of charging performance of the second charging unit 113Y can be prevented, and prolongation of life can be realized. The charging uniformity is further improved and image quality uniformity is improved.

Figure 4:
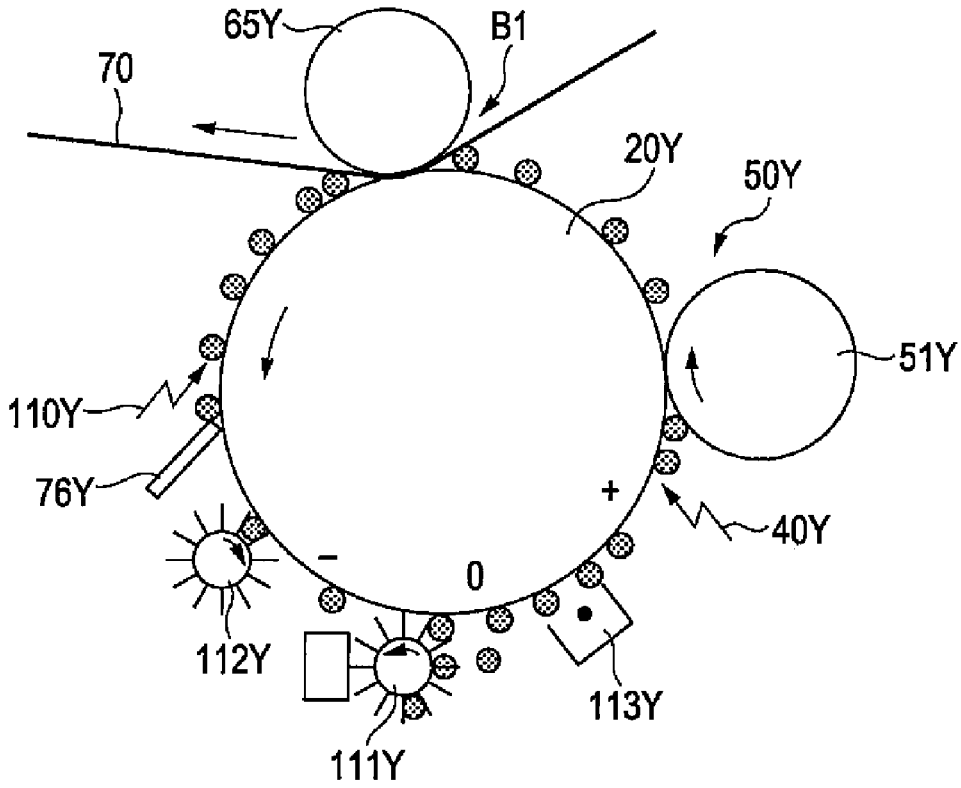
FIG. 4 is a view showing the embodiment of the invention.

FIG. 4 shows an image forming apparatus 10 according to Embodiment 3 for solving the problems of the known apparatus, in the image forming apparatus for applying the protective agent on the photosensitive body 20 (Y, M, C, K). Although the image forming apparatus of Embodiment 3 may be applied to a single-color image forming apparatus, FIG. 4 shows, for example, a yellow image forming unit 15Y of a color image forming apparatus.

In the photosensitive body 20Y, a neutralizing unit 110Y made of a Light Emitting Diode (LED) or the like is disposed at the downstream side of the primary transfer portion B1 such that the photosensitive body 20Y is neutralized. The photosensitive body cleaning blade 76Y supported by the photosensitive body cleaning unit 75Y is disposed on the downstream side of the neutralizing unit 110Y in counter contact with the rotation direction of the photosensitive body 20Y so as to clean the photosensitive body 20Y after primary transfer. The contact pressure of the photosensitive body cleaning blade 76Y to the photosensitive body 20Y is 15 g/cm.

The first charging unit 112Y, which is the main charging unit, is disposed at the downstream side of the photosensitive body cleaning blade 76Y. The first charging unit 112Y charges the photosensitive body 20Y to the same polarity as the regular charging polarity of the toner. The first charging unit 112Y of Embodiment 3 is a conductive brush roller. The conductive brush roller which is the first charging unit 112Y is rotated in the direction (clockwise direction) opposite to the rotation direction (counter-clockwise direction) of the photosensitive body 20Y. In Embodiment 3, a DC bias of −1500 V exceeding 600 V which is the discharge limit of the photosensitive body used in the present embodiment is applied to the first charging unit 112Y such that the potential of the photosensitive body 20Y is charged to −900 V.

The protective agent supplying unit 111Y is disposed at the downstream side of the first charging unit 112Y. In Embodiment 3, as the protective agent supplying unit 111Y, an insulating brush roller on which the protective agent is applied from a zinc stearate block supplies the protective agent to the photosensitive body 20Y. The insulating brush roller is rotated in the counter-clockwise direction which is the same direction as the rotation direction of the photosensitive body 20Y.

A second charging unit 113Y which is an auxiliary charging unit is disposed at the downstream side of the protective agent supplying unit 111Y. The second charging unit 113Y charges the protective agent supplied to the photosensitive body 20Y by the protective agent supplying unit 111Y to the opposite polarity to the regular charging polarity of the toner. The second charging unit 113Y of Embodiment 2 uses a non-contact type scorotron charger. The scorotron charger applies a bias of −500 V having the same polarity as the regular charging polarity of the toner to a grid, flows current of +200 μA having the opposite polarity to the regular charging polarity of the toner to a wire, spreads corona having the opposite polarity to the toner while maintaining the charging potential of the photosensitive body at the same polarity as the regular charging polarity of the toner, and charges the protective agent to the opposite polarity to the regular charging polarity of the toner. The potential of the photosensitive body 20Y after charging by the second charging unit 113Y becomes −500 V.

The configuration in which the exposure unit 40Y is disposed at the downstream side of the second charging unit 113Y, the development unit 50Y is disposed at the downstream side of the exposure unit 40Y and the primary transfer unit is disposed at the downstream side of the development unit 50Y is equal to that of the image forming apparatus of Embodiment 1 and thus the description thereof will be omitted.

The operation of the image forming process of Embodiment 3 is shown in Table 5.

TABLE 5

| Process | Member | Applied bias | Potential of photosensitive body | Polarity of protective agent |
|---|---|---|---|---|
| First charging unit | Brush roller (insulating) | Vbr: −1500 V | 0 V<br>−900 V | (+)<br>(−) |
| Protective agent supplying unit | Brush roller (insulating) | | | 0 |
| Second charging unit | Scorotron | Vg: −500 V<br>Iw: +200 μA | −500 V | + |
| Exposure | Laser | | −100 V/−500 V | |
| Development | AC non-contact (metallic roller) | Vavg: −150 V<br>Vpp: 1300 V | | |
| Primary transfer | Intermediate transfer belt (PET base material) | Vt = +400 V | | |
| Neutralizing | LED | | 0 V | |
| Cleaning | Blade counter contact | | | |

The result of the process of the image forming apparatus of Embodiment 3 shown in Table 5 is shown in Table 6.

TABLE 6

| | Embodiment 3 |
|---|---|
| Mixing of protective agent into development device | ○ |
| Discharge product | Δ |
| Removal of photosensitive film | ○ |
| Generation of ozone | Δ |
| Abrasion of blade | ○ |
| Contamination of charging member | ○ |
| Charging uniformity | ○ |

In the image forming apparatus of Embodiment 1, by disposing the second charging unit 113Y at the downstream side of the protective agent supplying unit 111Y and at the upstream side of the development unit 50Y, the protective agent is charged to the opposite polarity to the polarity of the toner, and is not recovered to the development unit by a potential difference between the development roller and the non-exposure unit of the photosensitive body in the non-exposure unit. Since the protective agent is recovered by a potential difference between the exposure unit of the photosensitive body and the development roller in the exposure unit but the toner is developed in the exposure unit, a probability in which the protective agent is recovered to the development device is low, the area of a printing unit upon actual printing is generally smaller than that of a non-printing unit. If the printing area is large, consumption of toner is large, a risk in which the toner or the protective agent continues to stay on the development roller 51Y is decreased and a risk of filming is reduced.

In the image forming apparatus of Embodiment 3, the protective agent supplying unit 111Y is disposed between the first charging unit 112Y and the second charging unit 113Y. Since the protective agent becomes uniform by the photosensitive body cleaning blade 76Y and is charged into the charger in a state of being filmed, the surface of the photosensitive body 20Y can be uniformly protected.

In the image forming apparatus of the invention, by applying the protective agent to the photosensitive body and providing the second charging unit for charging the protective agent to the charging opposite polarity to the regular charging polarity of the toner, mixing of the protective agent into the development device and the transferring of the protective agent to the transfer member of the transfer unit are prevented and thus high-quality image can be obtained.

The entire disclosure of Japanese Patent Application No. 2008-185454, filed Jul. 17, 2008 is expressly incorporated by reference herein.

What is claimed is:

1. An image forming apparatus comprising:

a rotatable image carrier;

a protective agent supplying unit supplying a protective agent to the image carrier;

a first charging unit charging the image carrier to the same polarity as a regular charging polarity of a toner such that the image carrier has the same polarity as the regular charging polarity of the toner;

a second charging unit charging the protective agent supplied to the image carrier to the opposite polarity to the regular charging polarity of the toner such that the protective agent has the opposite polarity to the regular charging polarity of the toner;

an exposure unit forming an electrostatic latent image on the image carrier;

a development unit developing the electrostatic latent image of the image carrier; and a transfer unit transferring the image of the image carrier, wherein the second charging unit is disposed between the protective agent supplying unit and the development unit.

2. The image forming apparatus according to claim 1, wherein the second charging unit charges the image carrier to a potential smaller than the potential of the image carrier charged by the first charging unit in an absolute value thereof.

3. The image forming apparatus according to claim 1, wherein the second charging unit is disposed next to the first charging unit.

4. The image forming apparatus according to claim 1, wherein the protective agent supplying unit is disposed at the upstream side of the first charging unit.

5. The image forming apparatus according to claim 1, further comprising an image carrier cleaner cleaning the image carrier after transfer, wherein the protective agent supplying unit is disposed between the first charging unit disposed next to the image carrier cleaner and the second charging unit.

6. The image forming apparatus according to claim 1, wherein the second charging unit is a charging roller which is in contact with the image carrier.

7. The image forming apparatus according to claim 1, wherein the second charging unit is a corona charger which is not in contact with the image carrier.

8. The image forming apparatus according to claim 7, wherein the corona charger is a scorotron charger, applies a bias having the same polarity as the regular charging polarity of the toner to a grid, and flows current having the opposite polarity to the regular charging polarity of the toner to a wire.

9. The image forming apparatus according to claim 1, wherein the development unit is not in contact with the image carrier.

10. The image forming apparatus according to claim 1, wherein the first charging unit charges the image carrier and the protective agent such that the image carrier and the protective agent have the same polarity as the regular charging polarity of the toner; and the second charging unit charges the protective agent supplied to the image carrier such that the protective agent supplied to the image carrier has the opposite polarity to the regular charging polarity of the toner while charging the image carrier such that the image carrier has the same polarity as the regular charging polarity of the toner.

* * * * *